United States Patent [19]

Komiyama et al.

[11] 4,202,166

[45] May 13, 1980

[54] SOLID STATE WATCH MODULE CONSTRUCTION

[75] Inventors: Katsuhiko Komiyama, Tokyo; Noriyuki Kasama, Hino; Keiji Tsukamoto, Tokyo; Tomomi Murakami, Higashi-Yamato, all of Japan

[73] Assignee: Citizen Watch Co., Ltd., Tokyo, Japan

[21] Appl. No.: 958,580

[22] Filed: Nov. 7, 1978

Related U.S. Application Data

[63] Continuation of Ser. No. 727,500, Sep. 28, 1976, abandoned.

[30] Foreign Application Priority Data

| | | | |
|---|---|---|---|
| Oct. 1, 1975 | [JP] | Japan | 50-118599 |
| Oct. 7, 1975 | [JP] | Japan | 50-121136 |
| Oct. 13, 1975 | [JP] | Japan | 50-122489 |
| Oct. 21, 1975 | [JP] | Japan | 50-125971 |

[51] Int. Cl.[2] ..... G04B 19/30; G04C 3/00

[52] U.S. Cl. ..... 368/82; 368/88; 368/204

[58] Field of Search ..... 58/23 R, 23 BA, 50 R, 58/88 R

[56] References Cited

U.S. PATENT DOCUMENTS

| | | | |
|---|---|---|---|
| 3,672,155 | 6/1972 | Bergey et al. | 58/50 R |
| 3,800,565 | 4/1974 | Bergey | 58/50 R |
| 3,905,666 | 9/1975 | Grimm et al. | 58/23 R X |
| 3,934,401 | 1/1976 | Wood | 58/23 R |
| 3,977,176 | 8/1976 | Mukakami et al. | 58/23 BA |
| 3,983,689 | 10/1976 | Burke et al. | 58/50 R |
| 4,019,313 | 4/1977 | Mason et al. | 58/23 R |
| 4,020,627 | 5/1977 | Yoshida et al. | 58/50 R |

*Primary Examiner*—Vit W. Miska

*Attorney, Agent, or Firm*—Frank J. Jordan

[57] ABSTRACT

A solid state watch module construction has a ceramic substrate on which an integrated circuit chip is mounted to provide drive signals for causing an electro-optical display means to indicate the time. The ceramic substrate is interposed between a battery supporting frame and a cell supporting frame which positions the electro-optical display means with respect to the substrate. The battery supporting frame holds a battery in place, which is retained by a battery retaining member. A connector member is disposed between the ceramic substrate and the electro-optical display means to provide electrical connection therebetween. A plurality of tubes are used for fixedly connecting the battery supporting frame and the cell supporting frame.

5 Claims, 12 Drawing Figures

SOLID STATE WATCH MODULE CONSTRUCTION

This is a continuation of application Ser. No. 727,500, filed Sept. 28, 1976, abandoned.

This invention relates in general to solid state electronic wristwatches with electro-optical displays for indicating the time, and more particularly to a module construction of a solid state electronic wristwatch.

In electronic wristwatches, it has been a common practice to employ an integrated circuit chip to provide drive signals for causing display of the time. The integrated circuit chip is usually supported on a ceramic substrate to ensure a reliable operation of the watches. It is widely known that manufacturing costs may be reduced and assembly of the module construction simplified by utilizing such ceramic substrate as a base plate of the wristwatch although a major drawback is encountered in view of the fragility of the ceramic. More specifically, a battery of the watch has the highest mass among the watch components and does not have in itself any particular problems when accommodated by a ceramic substrate. However, if the wristwatch should fall from a desk or table the ceramic substrate is likely to break under the weight of the battery applied to it upon impact. Another problem is encountered in that the watch module is complicated in construction and it is difficult to assemble and repair.

It is therefore an object of the present invention to provide an improved shock-resistant module construction for a solid state electronic wristwatch.

It is another object of the present invention to provide an improved construction for a ceramic substrate of a solid state electronic wristwatch which is simple in construction and low in manufacturing costs.

It is another object of the present invention to provide an improved solid state watch module construction which is easy to assemble and repair.

These and other objects, features and advantages of the present invention will become more apparent from the following description when taken in conjunction with the accompanying drawings, in which.

Figure 1:
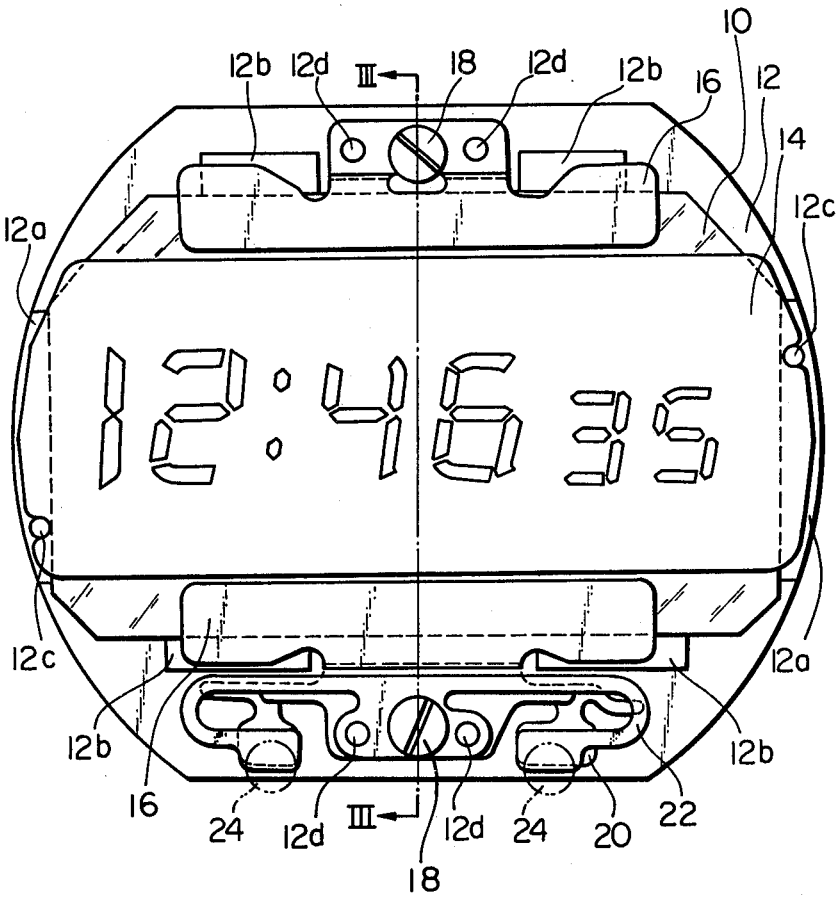
FIG. 1 is plan view of a preferred embodiment of a module construction of a solid state electronic wristwatch according to the present invention.
Figure 3:
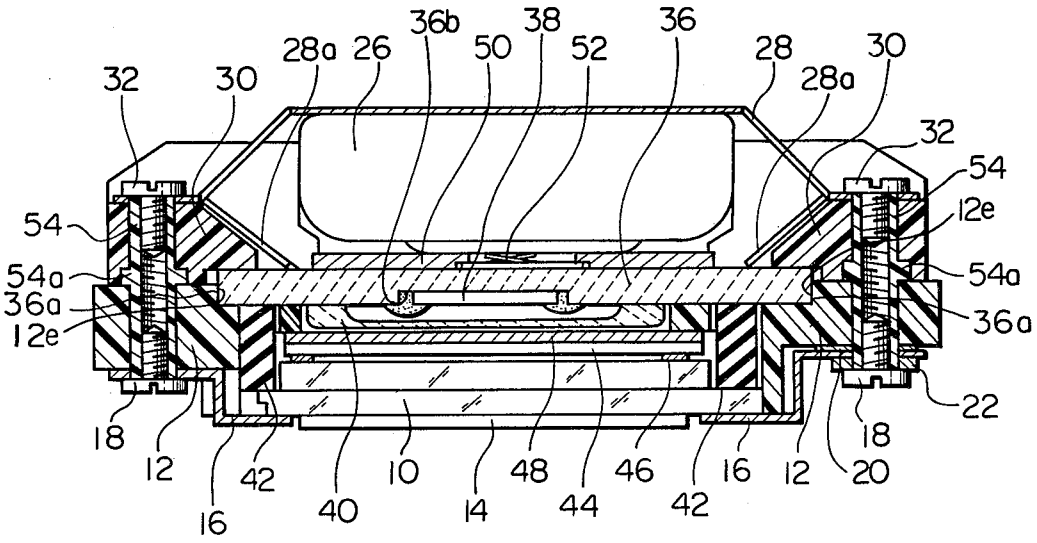
FIG. 3 is a cross section taken along line III—III of FIG. 1.

Referring now to FIGS. 1 and 3, an electro-optical display 10 is positioned by means of engaging portions 12*a* and 12*b* of a cell supporting frame 12, which is preferably made of plastic. The electro-optical display 10 may be any of the various types proposed in the prior art such as liquid crystal, electrophoretic, light emitting diode, electrochromic, etc., which are driven by driving signals from the integrated circuit chip which will be subsequently described in detail. The type of the display in the preferred embodiment is a liquid crystal cell having a polarizing plate 14.

The polarizing plate 14 is positioned with respect to the electro-optical display 10 by means of pins 12*c* provided on the cell supporting frame 12. A pair of metallic pressure plates or cell retaining plates 16 are positioned with respect to the electro-optical display 10 by means of positioning pins 12*d* provided on the cell supporting frame 12 and fixed thereto by screws 18 to hold the electro-optical display 10 in place.

Designated as 20 is a switch spring which is associated with a return spring 22. When either one of switches 24 shown by phantom lines in FIG. 1 is depressed, the switch is closed to provide electrical connection between the components. These components do not constitute essential part of the present invention and, therefore, a detailed description of the same is herein omitted.

Figure 2:
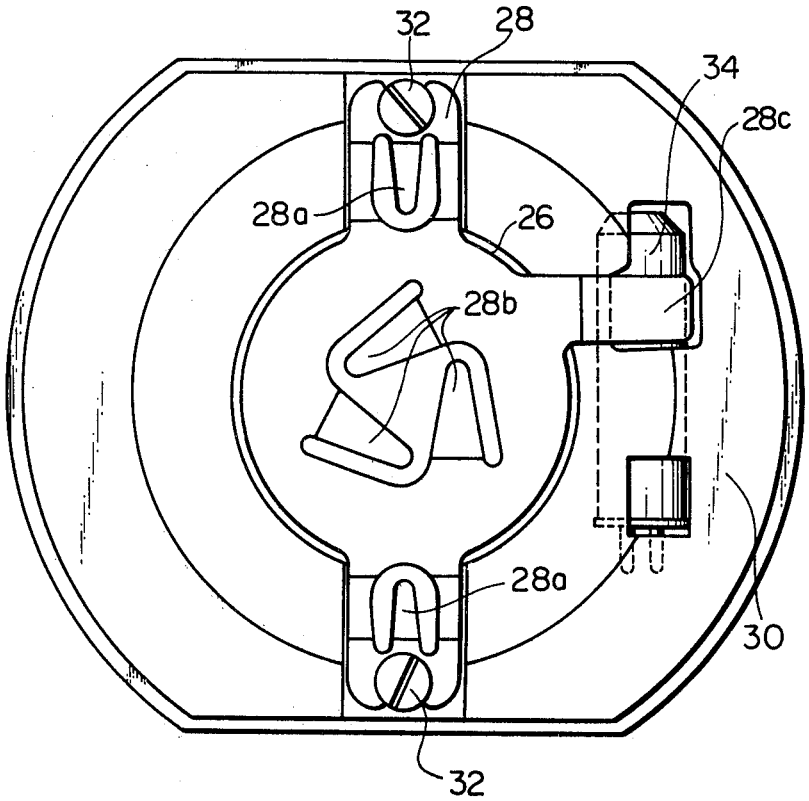
FIG. 2 is a bottom view of the watch module construction shown in FIG. 1.

In FIG. 2, a battery 26 is located in a central portion of a watch module construction by which a back cover of a watch case may be provided with a slanted wall to reduce the thickness of the watch case. The battery 26 is urged by a battery retaining plate 28, which is secured to a battery supporting frame 30 by means of screws 32. The supporting frame 30 may preferably be made of plastic. The battery retaining plate 28 has a pair of inwardly slanted portions 28*a*, a spring portion 28*b* to ensure electrical contact between the retaining plate 28 and the battery 26, and a projection 28*c* to hold a quartz crystal oscillator 34 in place. The slanted portions 28*a* are held in electrical contact with electrical terminals of a ceramic substrate to provide the electrical conductance between the positive electrode of the battery 26 and terminals on the substrate.

In FIG. 3, the ceramic substrate 36 is interposed between the cell supporting frame 12 and the battery supporting frame 30 and positioned along its outer periphery 36*a* by means of a recess 12*e* of the cell supporting frame 12. The ceramic substrate 36 has a recess 36*b* formed on one side thereof, on which an integrated circuit chip 38 is mounted. The integrated circuit chip 38 is connected via printed circuit leads to electrical terminals on the substrate 36 and provide driving signals via these electrical terminals to the electro-optical display 10 to cause the display of the time. A chip protecting cover 40 is mounted on the substrate 36 to protect the integrated circuit chip 38, and preferably made of a ceramic material.

As previously noted, the cell supporting frame 12 supports the electro-optical display 10, which is held in place with respect to the substrate 36 by means of an intermediate connector member 42. The intermediate connector member 42 may preferably be made of a conductive rubber. As already described above, since the electro-optical display 10 is urged inward by the retaining plates 16, the intermediate connector member 42 is held in pressured contact with the substrate 36 and the display 10 to ensure the electrical conductance between the electrical terminals provided on both components.

A second polarizing plate 44 is mounted on the display 10 by means of spacers 46. A reflecting plate 48 is mounted on the second polarizing plate 44.

Figure 4:
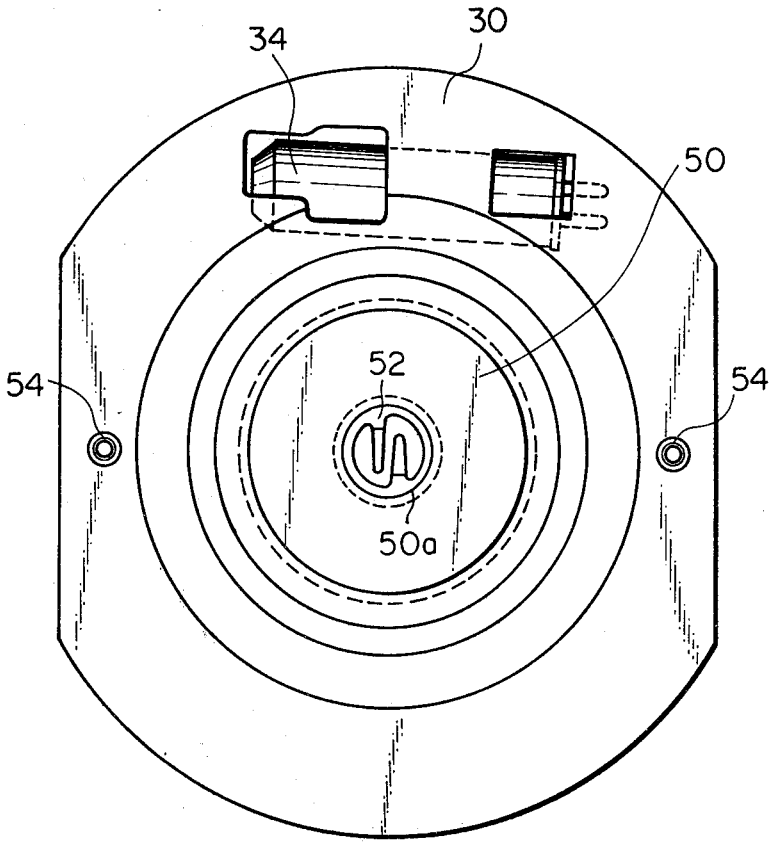
FIG. 4 is a view similar to FIG. 2 but shows a condition in which a battery and a battery retaining spring are removed.

A metallic intermediate battery supporting plate 50 is placed on the other surface of the substrate 36 and serves as a shock absorbing means to prevent the negative electrode of the battery 26 to be brought into direct contact with the substrate 36 in a case in which the timepiece is dropped. The supporting plate 50 has a recess 50*a*, in which a spring 52 is disposed a shown in FIGS. 3 and 4 to ensure electrical conductance between the negative electrode of the battery 26 and the electrical terminals on the substrate 36. The spring 52 has a portion engaging a shoulder portion of the recess 50*a* of the supporting plate 50 and, therefore, it will be held in place whenever the battery is replaced.

The battery supporting frame 30 and the cell supporting frame 12 are assembled together by means of tubes 54 which are press fitted into bores formed in the battery supporting frame 30. The tubes 54 have stepped portion 54*a*, which are partially cut to prevent rotation of the tubes. It should be understood that the tubes 54 may be press fitted into bores formed in the cell supporting frame 12, if desired.

During assembly, the battery supporting frame 30 is capsized and the intermediate supporting plate 50 is placed on the frame 30. The spring 52 is disposed in the recess 50*a* of the supporting plate such that the end of the spring 52 engages the shoulder portion of the recess 50*a*. The ceramic substrate 36 is also placed on the supporting frame 30. The cell supporting frame 12 is superimposed on the substrate 36 and positioned with respect thereto by means of tubes 54. Thereafter, the intermediate connector member 42 is placed on the substrate 36. The reflecting plate 48, the second polarizing plate 44, the spacers 46 and the display cell 10 are disposed in a space defined by the connector member 42. The display cell 10 is then held in place by the retaining plates 16, which are secured to the frame 12 by the screws 18. Thus, a watch module construction is assembled. Subsequently, the watch module construction is capsized, and the battery 26 is disposed in a recess of the frame 30. Thereafter, the battery retaining member 28 is secured to the frame 30 by the screws 30.

If the support plate 50 as disclosed in the present invention is removed and the negative electrode of the battery brought into direct contact with the ceramic substrate 36, the substrate will break when such a timepiece is subject to an impact test according to ISO standards for a case in which the timepiece is dropped from a height of one meter. This is due to the fact that upon impact the impact forces attains a value of approximately 3000 G to 5000 G which means that a battery having a weight of 2 g will subject the ceramic substrate to an impact load of approximately 6 kg to 10 kg. It has been revealed by experiment that this load is concentrated at one point on the ceramic substrate thereby causing it to break. The same impact when applied to a timepiece equipped with metallic battery support plate 50 having a thickness of 0.2 to 0.5 mm showed that the ceramic substrate 36 remained unbroken upon impact.

Figure 5:
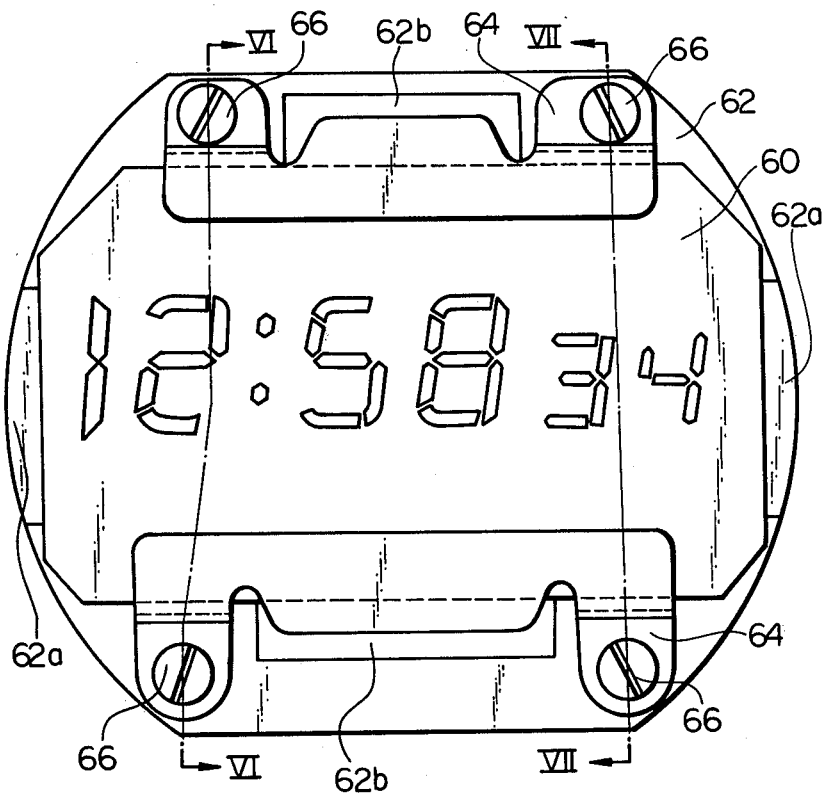
FIG. 5 is a plan view of another preferred embodiment of a watch module construction according to the present invention.
Figure 6:
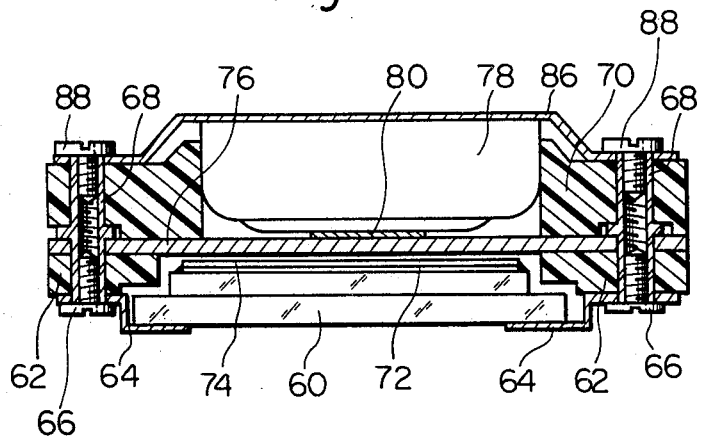
FIG. 6 is a cross section taken along line VI—VI of FIG. 5.
Figure 7:
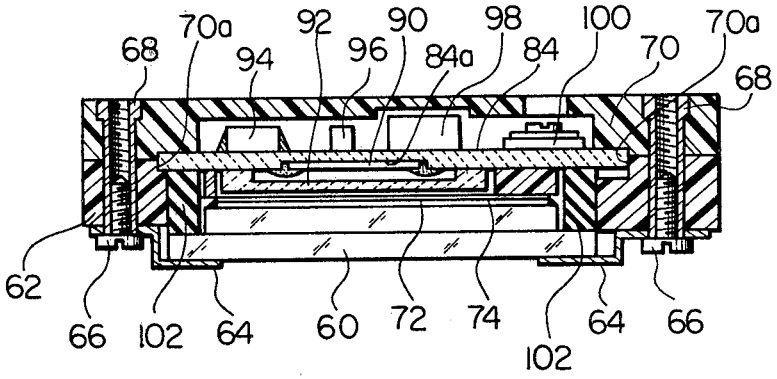
FIG. 7 is a cross section taken along line VII—VII of FIG. 5.

Another preferred embodiment of a solid state watch module construction of the present invention is illustrated in FIGS. 5 to 8. In FIGS. 5 to 7, an electro-optical display 60 such as a liquid crystal cell is disposed on a cell supporting frame 62. The cell supporting frame 62 is preferably made of plastic and held in engagement with engaging portions 62*a* and 62*b* formed in the frame 62 such that the display 60 is positioned with respect to the frame 62. The display 60 is held in place by means of a pair of cell retaining plates 64, which are fixed to the frame 62 by screws 66 screwed into tubes 68 preferably made of metal. The tubes 68 are press fitted into bores of a battery supporting frame 70, which is also preferably made of metal.

In FIGS. 6 and 7, the display 60 has a polarizing plate 72 attached thereto by some suitable adhesive, and a reflecting plate 74 attached on the polarizing plate 72 by the adhesive.

Figure 8:
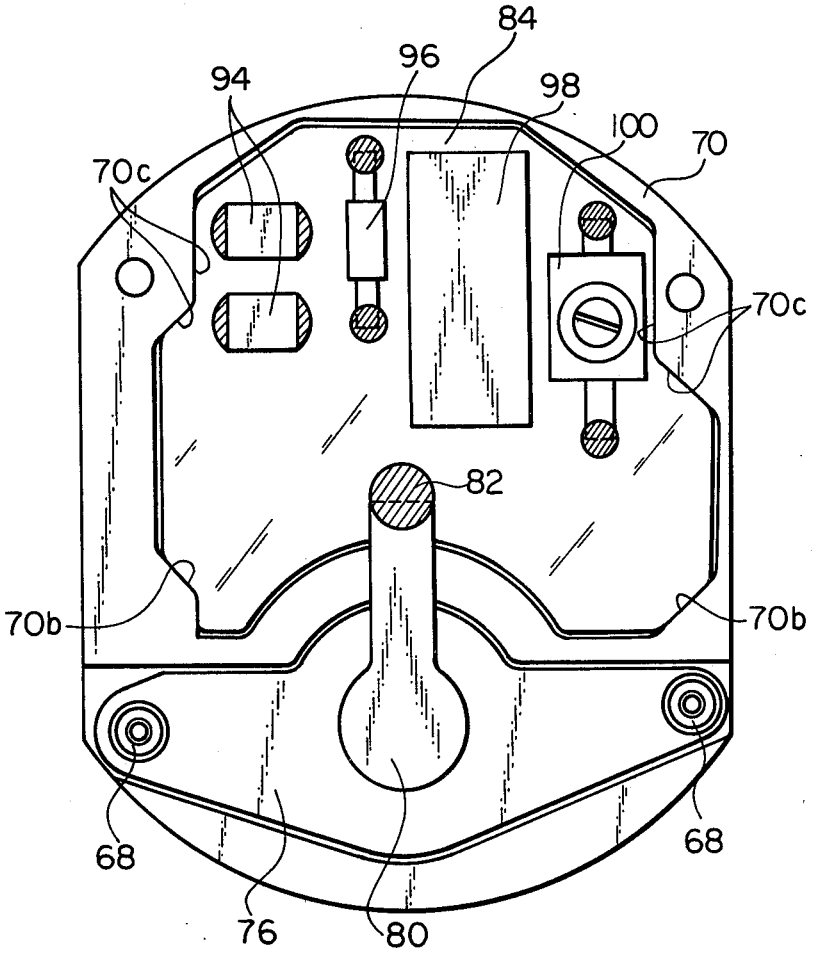
FIG. 8 is a bottom view in which a battery supporting frame is removed.

As shown in FIGS. 6 and 8, an intermediate battery supporting plate 76 is interposed between the cell supporting frame 62 and the battery supporting frame 70. The supporting plate 76 is preferably made of metal and serves as a shock absorbing member to prevent a battery 78 from directly contacting the display cell 60. The supporting plate 76 has a lead plate 80 preferably made of flexible conductive sheet and extending toward a terminal 82 formed on a ceramic substrate 84. The battery 78 is positioned with respect to the lead plate 80 by means of a recess 70*a* of the supporting frame 70 and held in place by a battery retaining plate 86. The plate 86 is fixed to the frame 70 by screws 88 screwed into the tubes 68.

As shown in FIGS. 7 and 8, the ceramic substrate 84 is positioned in a recess 70*a* of the cell supporting frame 70 and fixed in place by the frames 62 and 70. The ceramic substrate 84 has a recess 84*a* formed on one side thereof in which an integrated circuit chip 90 is mounted. A protecting cover 92 is mounted on the one side of the substrate 84 to protect the integrated circuit chip 90. The substrate 84 carries on its another side input capacitors 94, an output capacitor 96, a quartz crystal oscillator 98, and a trimming capacitor 100, which are connected to a circuit pattern of the substrate 84 by soldering, etc. and connected to the integrated circuit chip 90 to apply a standard frequency signal thereto. The integrated circuit chip 90 is arranged to divide down the frequency signal to provide driving signals to drive the display cell 60 to cause the display of time. Indicated as 102 is a connector member which is held in pressured contact with the substrate 84 and the display cell 60 to ensure electrical conductance therebetween.

Figure 9:
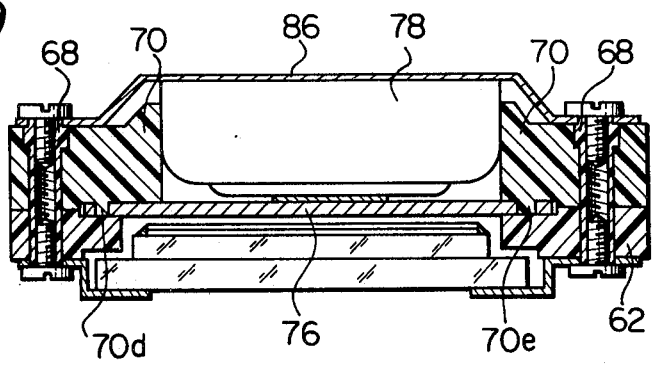
FIG. 9 is a cross section of a modification of the watch module construction shown in FIGS. 5 to 8.

FIG. 9 shows a modified form of the solid state watch module construction of FIGS. 5 to 8, with like parts bearing the same reference numerals as those used therein. In this modification, the battery supporting frame 70 is formed with engaging portions 70*d* and 70*e*, by which the intermediate battery supporting plate 76 is positioned. It should be noted that the cell supporting member 62 may be formed with engaging portions similar to those of the battery supporting member 70 to position the intermediate supporting plate 76.

Figure 10:
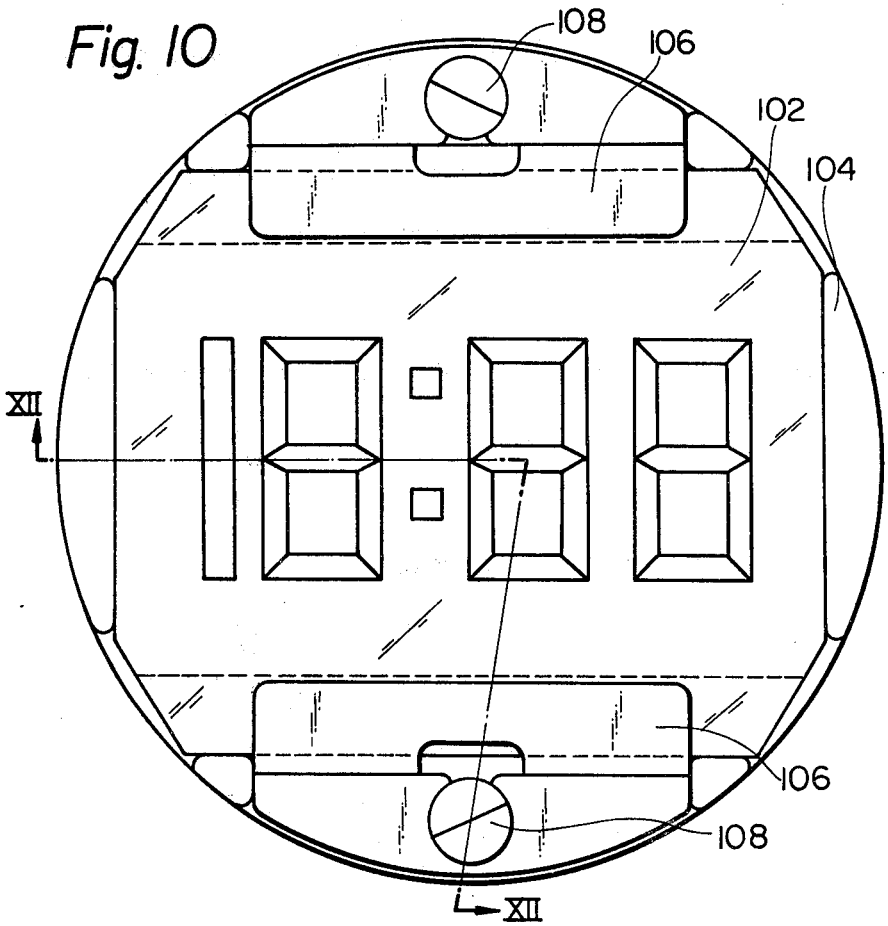
FIG. 10 is a plan view of a further preferred embodiment of a watch module construction according to the present invention.
Figure 12:
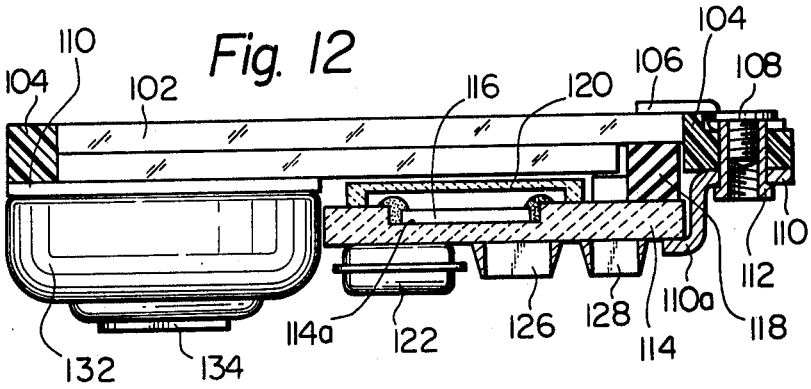
FIG. 12 is a cross section taken along line XII—XII of FIGS. 10 and 11.

Another preferred embodiment of a watch module construction of the present invention is shown in FIGS. 10 and 12. In FIG. 10, an electro-optical display 102 such as a liquid crystal display cell is supported by a cell supporting frame 104, and fixed in place by a pair of cell retaining plates 106. The cell retaining plates 106 are fixed to the cell supporting frame 104 by screws 108.

Figure 11:
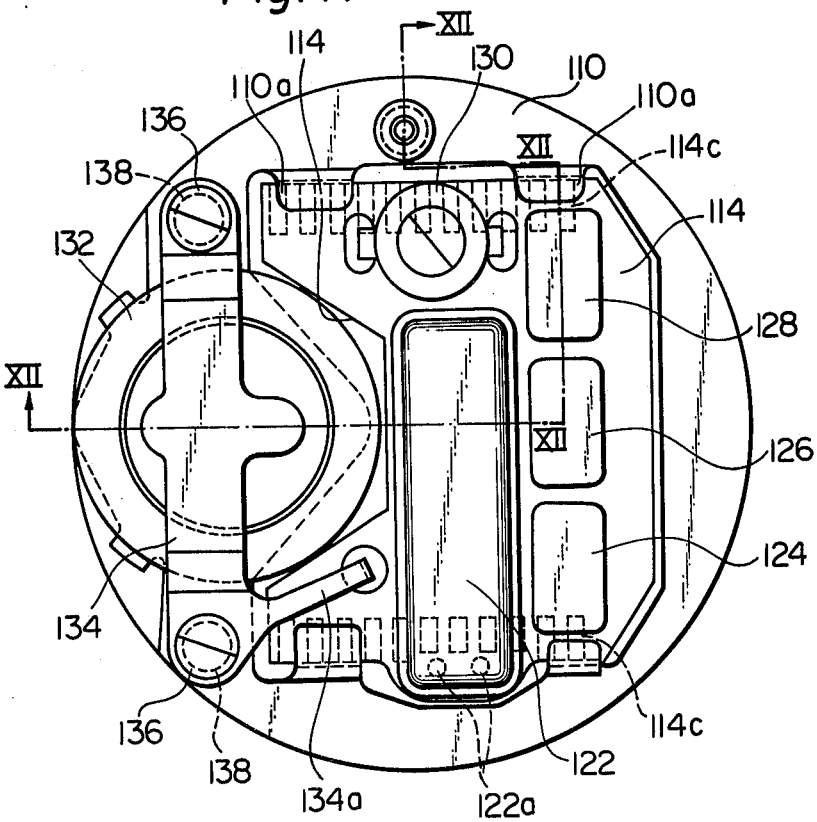
FIG. 11 is a view showing the back side of the watch module construction of FIG. 10.

As shown in FIGS. 11 and 12, a base plate 110 made of metal is fixed to the cell supporting frame 104 by tubes 112 into which the screws 108 are screwed. The base plate 110 has L-shaped or bended portions 110 to hold a ceramic substrate 114 in place with respect to the liquid crystal cell 102. The ceramic substrate 114 is formed at one side thereof a recess **114*a* in which an integrated circuit chip 116 is mounted. The integrated circuit chip 116 is connected to printed circuit leads on the substrate 114 and also connected to external terminals of the display cell 102 by means of a connector member 118 connected to output terminals 114*c* provided on the substrate 114. The connector member 118 is preferably made of a conductive rubber. A protecting cover 120 is mounted on the one side thereof to protect the integrated circuit chip 116. A quartz crystal oscillator 122 is mounted on the other side of the ceramic substrate 114, on which capacitors 124, 126 and 128 and a trimming capacitor 130 are also mounted. The oscillator 122 has output lead pins 122*a* which are soldered to the ceramic substrate 114** and interconnected with the integrated circuit chip to apply thereto a standard frequency signal.

A battery 132 is placed on the base plate 110 in a space provided by a recess **114*b* of the ceramic substrate 114 (see FIG. 11) such that the positive electrode contacts the base plate 110, and held in place by means of a battery retaining spring 134 preferably made of a metal. The battery retaining spring 134 is held in electrical contact with the negative electrode of the battery 132, and fixed to the base plate 110 by screws 136 screwed into tubes 138 made of insulating material. The battery retaining spring 134 has a lateral extension 134*a* to provide electrical connection between the battery 132 and a terminal formed on the ceramic substrate 114 to supply power to the integrated circuit chip 116**.

It will now as appreciated from the foregoing description that in accordance with the present invention it is possible to provide a shock-resistant watch module construction which is easy to assemble and repair and low in manufacturing cost.

While the present invention has been shown and described with reference to particular embodiments, it should be understood that various other changes or modifications may be made without departing from the scope of the present invention.

We claim:

1. A solid state watch module construction having a battery, comprising:

a ceramic substrate having an integrated circuit chip mounted on one side of said substrate at a centrat portion thereof and providing drive signals indicative of time information, a first plurality of electrical terminals formed on the one side of said substrate and electrically connected to said integrated circuit chip through printed circuit leads, and a second plurality of electrical terminals formed on another side of said substrate and electrically connected to said integrated circuit chip and said battery to receive electric power therefrom;

a battery supporting frame having a first recess formed on one side of said battery supporting frame at a central portion thereof to support said battery at said central portion to be in vertical alignment with said integrated circuit chip, a second recess formed on another side of said battery supporting frame to support said substrate at said another side thereof, and a third recess formed between said first and second recesses;

a metallic intermediate battery supporting plate received in the third recess of said battery supporting frame and overlying said another side of said substrate, said battery supporting plate serving as shock absorbing means to prevent said battery from being brought into direct contact with said substrate when said module construction is subject to external shocks;

an electro-optical display cell responsive to said drive signals to provide a display of said time information and having a third plurality of electrical terminals;

a cell suppporting frame having a substrate retaining recess formed at one side of said cell supporting frame to position said substrate relative to said display cell, said cell supporting frame being fixedly secured to said battery supporting frame to retain said substrate between said substrate receiving recesses of said battery supporting frame and said cell supporting frame, and said cell supporting frame having a cell receiving recess formed on another side of said cell supporting frame at a central portion thereof to receive said display cell at a position opposing to said battery with respect to said substrate;

first and second connector members made of electrical conductive rubber, and disposed between said display cell and said substrate said first and second connector members positioning said display cell with respect to said substrate within said cell receiving recess and making electrical contact between the first and third plurality of electrical terminals; and first and second cell retaining plates rigidly secured to said cell supporting frame at the one side thereof to compress said display cell to said first and second connector members which are consequently held in pressured contact with said substrate to ensure electrical conductance between said first and third plurality of electrical terminals.

2. A solid state watch module construction having a battery, comprising:

a ceramic substrate having an integrated circuit-chip mounted on one side of said substrate at a central portion thereof and providing drive signals indicative of time information, first electrical terminals formed on said one side of said substrate and electrically connected to said integrated circuit chip through printed circuit leads, and second and third electrical terminals formed on another side of said substrate;

a battery supporting frame having a first recess formed on one side of said battery supporting frame at a central portion thereof to support said battery at said central portion to be in vertical alignment with said integrated circuit chip, a second recess formed on another side of said battery supporting frame to receive said substrate, and a third recess formed between said first and second recesses;

a metallic intermediate battery supporting plate disposed in said third recess between the negative side of said battery and said another side of said substrate to prevent said battery from directly contacting said substrate when said module construction is subject to external shocks, said metallic intermediate battery supporting plate having a central recess formed therein;

an electrically conductive spring disposed in the central recess of said metallic intermediate supporting plate between the negative side of said battery and the second electrical terminal of said substrate to make an electrical contact therebetween;

an electrically conductive battery retaining plate rigidly secured to said one side of said battery supporting frame to retain said battery in said first recess, said battery retaining plate including a spring portion in contact with the positive side of said battery, and an inwardly slanted portion connected to said spring portion and having its end in contact with said third electric terminal to provide an electrical contact therebetween;

an electro-optical display cell responsive to said drive signals to provide a display of said time information and having fourth electrical terminals;

a cell supporting frame having a substrate retaining recess formed at one side of said cell supporting frame to position said substrate relative to said display cell, said cell supporting frame being fixedly secured to said battery supporting frame to retain said substrate between said substrate receiving recesses of said battery supporting frame and said cell supporting frame, and said cell supporting frame having a cell receiving recess formed on another side of said cell supporting frame at a central portion thereof to receive said display cell at a position opposing to said battery with respect to said substrate;

first and second connector members made of electrical conductive rubber and disposed between said display cell and said substrate, said first and second connector members positioning said display cell with respect to said substrate within said cell receiving recess and making electrical contact between said first and fourth electrical terminals; and first and second cell retaining plates rigidly secured to said cell supporting frame at the one side thereof to compress said display cell to said first and second connector members which are consequently held in pressured contact with said substrate to ensure electrical conductance between said first and fourth.

3. A solid state watch module construction according to claim 2, in which said watch module construction also has a quartz cristal oscillator, and in which said battery supporting frame also has a cutout to receive said oscillator, and said battery retaining plate also includes a laterally extending projection to hold said oscillator in place in said cutout.

4. A solid state watch module construction having a battery, comprising:

a ceramic substrate having an integrated circuit chip mounted on one side of said substrate at a central portion thereof and providing drive signals indicative of time information, a first plurality of electrical terminals formed on the one side of said substrate and electrically connected to said integrated circuit chip through printed circuit leads, and a second electrical terminal formed on another side of said substrate and electrically connected to said integrated circuit chip and said battery to receive electric power therefrom; a battery supporting frame having a major axis and a minor axis and having a battery retaining recess formed on one side of said battery supporting frame at a position near one end thereof to support said battery and a substrate receiving recess formed on another side of said battery supporting frame at a position away from said battery retaining recess to receive the another side of said substrate;

a plurality of capacitors provided on the another side of said substrate in parallel with respect to one another along said minor axis;

a quartz crystal oscillator provided on the another side of said substrate in parallel with said plurality of capacitors;

an electro-optical display cell responsive to said drive signals to provide a display of said time information and having a third plurality of electrical terminals;

a cell supporting frame having a substrate retaining recess formed at one side of said cell supporting frame to position said substrate relative to said display cell, said cell supporting frame being fixedly secured to said battery supporting frame to retain said substrate between said substrate receiving recesses of said battery supporting frame and said cell supporting frame, an said cell supporting frame having a cell receiving recess formed on another side of said cell supporting frame to receive said display cell;

first and second connector members made of electrical conductive rubber and disposed between said display cell and said substrate, said first and second connector members positioning said display cell with respect to said substrate within said cell receiving recess and making electrical contact between said first and fourth electrical terminals;

first and second cell retaining plates rigidly secured to said cell supporting frame at the one side thereof to compress said display cell to said first and second connector members which are consequently held in pressured contact with said substrate to ensure electrical conductance between said first and third plurality of electrical terminals; and a metallic intermediate battery supporting plate disposed in vertical alignment with said battery between said battery supporting frame and said cell supporting frame and serving as shock absorbing means to prevent said battery from directly contacting said display cell when said module construction is subject to external shocks.

5. A solid state watch module construction according to claim 4, in which said battery supporting plate has a plurality of bores formed therein, and said battery supporting frame has a plurality of downwardly extending engagement projections formed on said another side of said battery supporting frame, said engagement projections engaging the bores of said battery supporting plate thereby positioning said battery supporting plate with respect to said battery supporting frame.

* * * * *